United States Patent [19]

Mohacsi et al.

[11] Patent Number: 4,665,835

[45] Date of Patent: May 19, 1987

[54] ARRANGEMENT TO INCREASE ROLL STABILITY OF RAIL VEHICLES WITH AIR SUSPENSION

[75] Inventors: Sandor Mohacsi; Gerd Potel; Karl-Heinz Buchholz, all of Nuremberg, Fed. Rep. of Germany

[73] Assignee: M.A.N. Maschinenfabrik Augsburg-Nürnberg Aktiengesellschaft, Nuremberg, Fed. Rep. of Germany

[21] Appl. No.: 703,891

[22] Filed: Feb. 21, 1985

[30] Foreign Application Priority Data

Mar. 1, 1984 [DE] Fed. Rep. of Germany ..... 3407574

[51] Int. Cl.[4] ..... B60G 11/64

[52] U.S. Cl. ..... 105/199.2; 105/217; 105/453

[58] Field of Search ..... 105/199 A, 164, 453, 105/217, 175 A, 197 T, 208.1, 208.2, 199.2; 267/4

[56] References Cited

U.S. PATENT DOCUMENTS

| | | | |
|---|---|---|---|
| 1,924,237 | 8/1933 | Glascodine | 267/4 X |
| 3,902,691 | 9/1975 | Ott | 105/199 A X |
| 4,279,202 | 7/1981 | Dieling et al. | 105/199 A X |

FOREIGN PATENT DOCUMENTS

| | | | |
|---|---|---|---|
| 2830359 | 1/1980 | Fed. Rep. of Germany . | |
| 8137758 | 6/1982 | Fed. Rep. of Germany . | |
| 2521089 | 8/1983 | France | 105/164 |

*Primary Examiner*—Robert B. Reeves
*Assistant Examiner*—Scott H. Werny
*Attorney, Agent, or Firm*—Becker & Becker, Inc.

[57] ABSTRACT

An arrangement for increasing the roll stability of rail vehicles equipped with air suspension. Two air spring bellows having integrated emergency springs of a first bogie are controlled by a respective leveling valve. In addition to these bellows, a roll stabilizer is provided, so that in the vicinity of the first bogie, the car body, when viewed in the horizontal direction, is nearly parallel to this bogie. So that when track twist is encountered, the second bogie can swing relative to the car body, only one of the air spring bellows of this bogie is controlled by a third leveling valve disposed in the center of the car body, while the other air spring bellows is connected via an equalizing line with one of the air spring bellows of the first bogie. A central emergency spring extends concentrically around the center pivot of the second bogie. Thus, the center of the car body is held at the same level by the second bogie, but swinging movements of the car body relative to this second bogie are possible when track twist is negotiated.

1 Claim, 3 Drawing Figures

ARRANGEMENT TO INCREASE ROLL STABILITY OF RAIL VEHICLES WITH AIR SUSPENSION

BACKGROUND OF THE INVENTION

1. Field of the Invention

The present invention relates to an arrangement for increasing the roll stability of rail vehicles which are equipped with air suspension.

2. Description of the Prior Art

It is known to control air spring bellows, which serve for the secondary suspension of rail vehicles, in such a manner that track twist will not affect derailing safety despite the torsional stiffness of a car body. To this end, the lateral air spring bellows of a first bogie are controlled by separate leveling valves, so that the car body is always kept approximately parallel to the bogie underneath it. The air spring bellows of a second bogie, however, are only controlled by a leveling valve arranged mid-way between the air spring bellows, so that while on the average the level corresponds to that of the air spring bellows of the first bogie, oscillating or swinging motions of the second bogie about its longitudinal axis under the car body are possible, so that track twist can be negotiated without any torsional deflection of the car body being necessary. Although this takes care of derailing safety of the car, such features fail to maintain satisfactory roll stability in certain cases, especially in the case of vehicles operating on a narrow track gauge where the supporting base of the air spring bellows is reduced (German Offenlegungsschrift No. 28 30 359).

It is also known to equip both bogies under a car body with roll stabilizers. It is common practice to have the roll stabilizer formed as a torsion bar which is rotatably supported in a bogie frame and is connected at both ends to the car body by means of horizontally positioned levers and vertically positioned links. While such a system is suitable to limit roll motions, it automatically interferes with the ability of both bogies to swing about their longitudinal axes, so that they cannot match track twist to the desired extent and, consequently, are susceptible to derailing where the car bodies are torsionally stiff.

In the case of bogies equipped with air suspension, it is known to provide an emergency support system on three points. In this arrangement, the emergency support of a first bogie takes the form of a rubber- bonded-metal composite spring integrated in each air spring bellows. The emergency support of the second bogie relies on an emergency spring positioned at the center pivot. This emergency spring may be formed as a coil spring or as a spring with elastomeric material. The clearance of this emergency support relative to the vertical travel of the air springs of this bogie is selected such that on deviation of either air bellows, the emergency spring will be first to take the load, and that the ability of this bogie to swing about its longitudinal axis is sufficient to enable it to match the usual track twist without any constraint. The drawback of this system is the insufficient roll stability of the air spring bellows (German Utility Patent No. 81 37 758).

In contrast to this, it is the object of the present invention to control roll motions without simultaneously reducing derailing safety.

BRIEF DESCRIPTION OF THE DRAWINGS

This object, and other objects and advantages of the present invention, will appear more clearly from the following specification in conjunction with the accompanying drawings of one exemplary inventive embodiment, in which.

SUMMARY OF THE INVENTION

The arrangement pursuant to the present invention for increasing the roll stability of rail vehicles is characterized primarily by the following combination of features:

(a) a car body is supported relative to a first bogie by two lateral air spring bellows, each air spring bellow having associated therewith a separate first and second leveling valve; the second bogie is also spring-supported relative to the car body by lateral air spring bellows, with one of the air spring bellows being controllable by means of a third leveling valve arranged in the region of the car center, whereas the other air spring bellows of the second bogie is connected with the air spring bellows of the first bogie on the same side of the car by means of an equalizing pipe;

(b) the first bogie is provided with a roll stabilizer arranged between the car body and the bogie frame; and (c) emergency supports are provided at three points, the first bogie featuring two emergency springs formed as rubber-bonded-metal composite springs and forming an integral unit with the air spring bellows, and the second bogie featuring a central emergency spring which concentrically extends around the center pivot of the bogie.

Due to the three point control system with longitudinal equalization, the second bogie is capable of conforming to or matching track twist without any constraint. Consequently, derailing safety is fully ensured, even in the case of torsionally stiff car bodies. The roll stabilizer of the first bogie prevents excessive roll. Since the car body is required to have adequate torsional stiffness, one roll stabilizer is sufficient; a second roll stabilizer would interfere with the capability of the second bogie to swing (about its longitudinal axis). The emergency supports provided at three points, in conjunction with the roll stabilizer, assure roll stability and, simultaneously, derailing safety.

One advantageous configuration of the roll stabilizer features a torsion bar which is mounted horizontally and transverse to the traveling direction, in the bogie frame; the torsion bar is provided with parallel levers at its ends; the levers are horizontal and parallel to the traveling direction, and at their free ends are vertically positioned links by means of which the car body bears against the levers.

DESCRIPTION OF PREFERRED EMBODIMENTS

Figure 1:
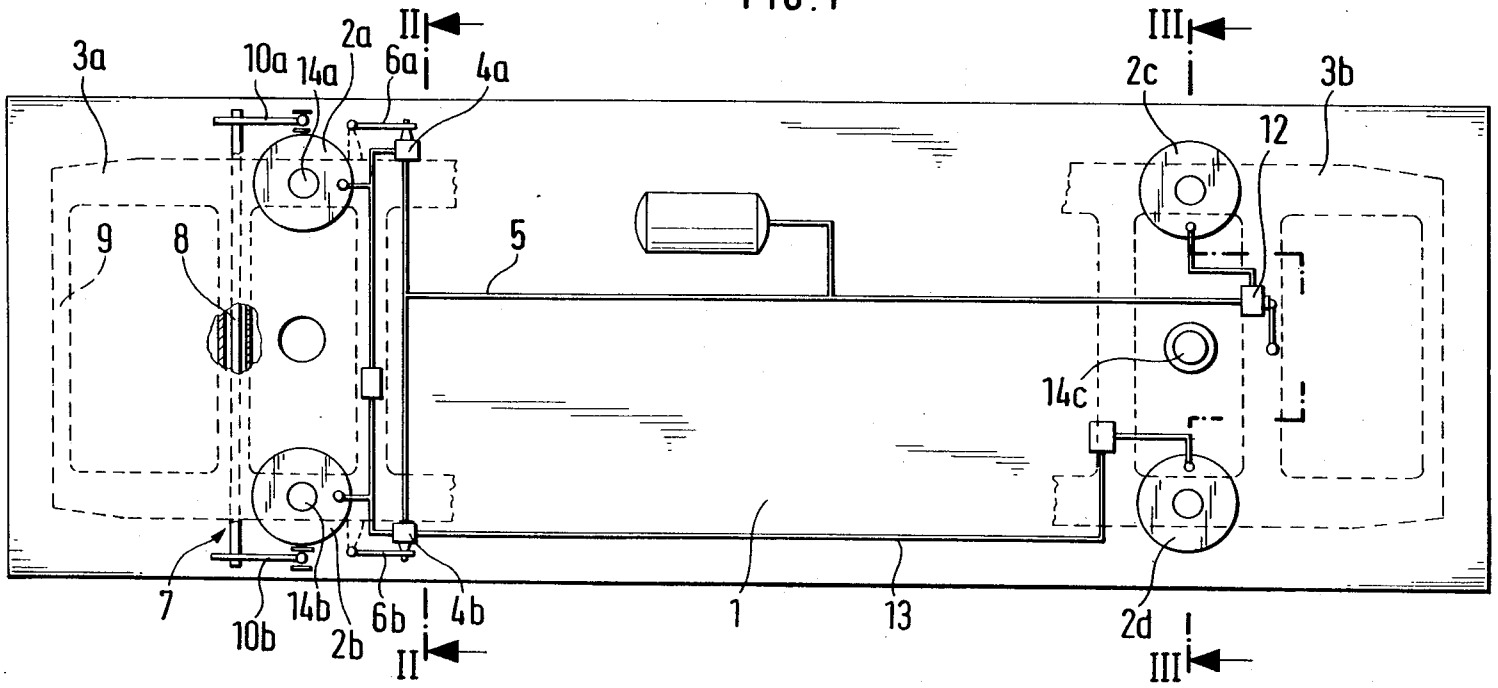
FIG. 1 is a plan view of a car body equipped with air suspension, and of a control arrangement of the leveling valves.

Referring now to the drawings in detail, a car body 1 which is supported via four air spring or compressed-air bellows 2*a* to 2*d* on bogies which are not shown in further detail, is illustrated in FIG. 1. The car body 1 is spring-supported via the air spring bellows 2*a* and 2*b* relative to a first bogie 3*a* and, via the air spring bellows 2*c* and 2*d*, relative to a second bogie 3*b*.

Figure 2:
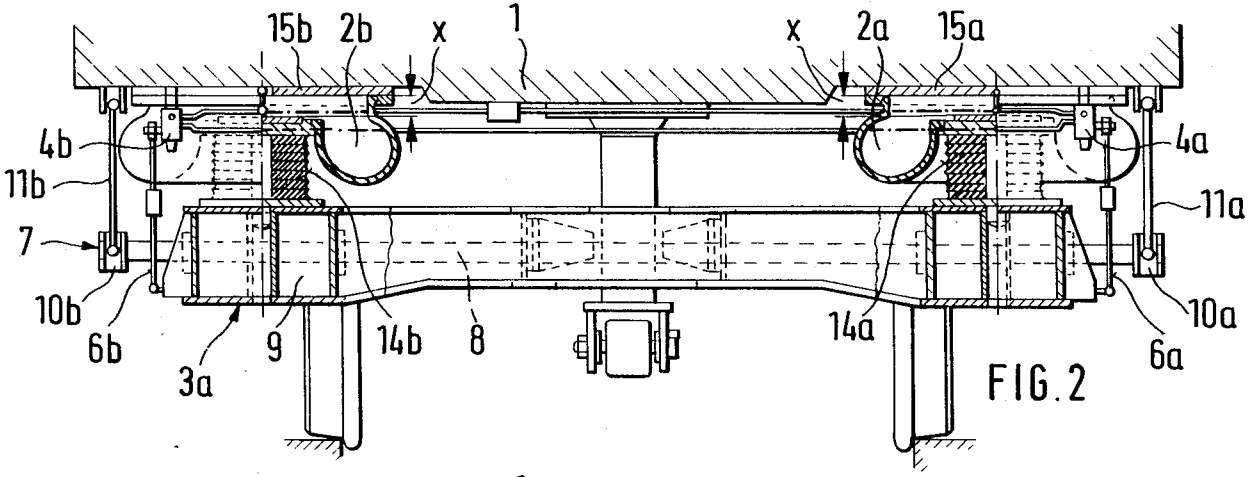
FIG. 2 is a section along the line II—II through a first bogie having a roll stabilizer and leveling valves.

The level of the air spring bellows 2*a* and 2*b* is controlled by respective first and second leveling valves 4*a* and 4*b*, which communicate with an air pipe 5. The leveling valves 4*a* and 4*b* are connected to the car body 1, and are controlled by a linkage 6*a*, 6*b* between the leveling valves 4*a*, 4*b* and the first bogie 3*a*. As a result, the car body 1 is always parallel to the first bogie at the preset level. In consequence of the flat characteristic of the air spring bellows, the car body 1 tends to roll relative to the first bogie 3*a*, especially where narrow gauges are involved, because the supporting base of the air spring bellows is then inherently reduced. According to the invention, this drawback is overcome in that the first bogie 3*a* is provided with a roll stabilizer 7, which may, for example, comprise a torsion bar 8 which is rotatably supported in a bogie frame 9 and is non-rotatably connected at its free ends to horizontal levers 10*a*, 10*b* which are arranged parallel to the direction of travel. As shown in FIG. 2, the levers 10*a*, 10*b* are connected via vertical links 11*a*, 11*b* to the car body 1.

The spring bellows 2*c* and 2*d* of the second bogie 3*b* (FIG. 3) are controlled by a third leveling valve 12 positioned near the center of the car, while the air spring bellows 2*d* is controlled via an equalizing pipe 13 which connects the air spring bellows 2*d* with the air spring bellows 2*b* of the first bogie. As a result of the fact that only the air spring bellows 2*c* is directly level-controlled, the second bogie 3*b* is capable of swinging about its longitudinal axis relative to the car body 1. However, the level of the car body 1 remains constant. Due to these features, the car is capable of negotiating track twist without individual wheels being unloaded and, consequently, derailing occurring.

In case one of the air spring bellows should leak, or air should escape from the spring system, an emergency support system is provided. This system is formed by three emergency springs 14*a* to 14*c*, of which the emrgency springs 14*a* and 14*b* are integrated into the air spring bellows 2*a* and 2*b*, whereas the third emergency spring 14*c* is arranged at the center of the car between the air spring bellows 2*c* and 2*d*. Due to this emergency support system which bears on three points, the capability of the second bogie 3*b* to swing about its longitudinal axis is maintained and, simultaneously, the tendency of the car to roll is controlled by the car body 1 coming to rest on the emergency springs 14*a* and 14*b*, with the roll stabilizer 7 assisting the control function.

A cross-section along the line 11—II in the area of the first bogie 3*a* is shown in FIG. 2. The car body 1 is spring-supported on the bogie frame 9 via the two lateral air spring bellows 2*a*, 2*b*. The air spring bellows 2*a* and the air spring bellows 2*b* are controlled by a first and second leveling valve 4*a* and 4*b*. The leveling valves 4*a*, 4*b* are connected at one end to the car body 1 and at the other end to the bogie frame 9 via links 6*a*, 6*b*. As a result of these features, the distance between the car body 1 and the bogie frame 9 is maintained constant, so that the bogie frame 9 is held approximately parallel to the car body 1.

The air spring bellows 2*a*, 2*b*, which are susceptible to roll motions, are assisted in the first bogie 3*a* by the roll stabilizer 7. This comprises the torsion bar 8 which is rotatably supported in the bogie frame 9; the ends of the torsion bar 8 are non-rotatably connected to the levers 10*a* and 10*b*. The horizontally positioned levers 10*a*, 10*b* are connected by means of links 11*a*, 11*b* to the car body 1. Tilting of the car body 1, for example, towards the left-hand side, causes the torsion bar 8 to be twisted via the link 11*b* and the lever 10*b*, which causes the lever 10*a* and the link 11*a* on the right-hand side to exert a resetting force downwards and, consequently, to counteract the roll motion towards the left-hand side.

Emergency spring support action in the first bogie 3*a* is provided by the emergency springs 14*a* and 14*b*, which are arranged at a distance "x" below the bellows plates 15*a* and 15*b* of the air spring bellows 2*a* and 2*b*. If the air spring bellows 2*a*, 2*b* should fail, or the air supply should fail, the bellows plates 15*a*, 15*b* would rest on the emergency springs 14*a* and 14*b*.

Figure 3:
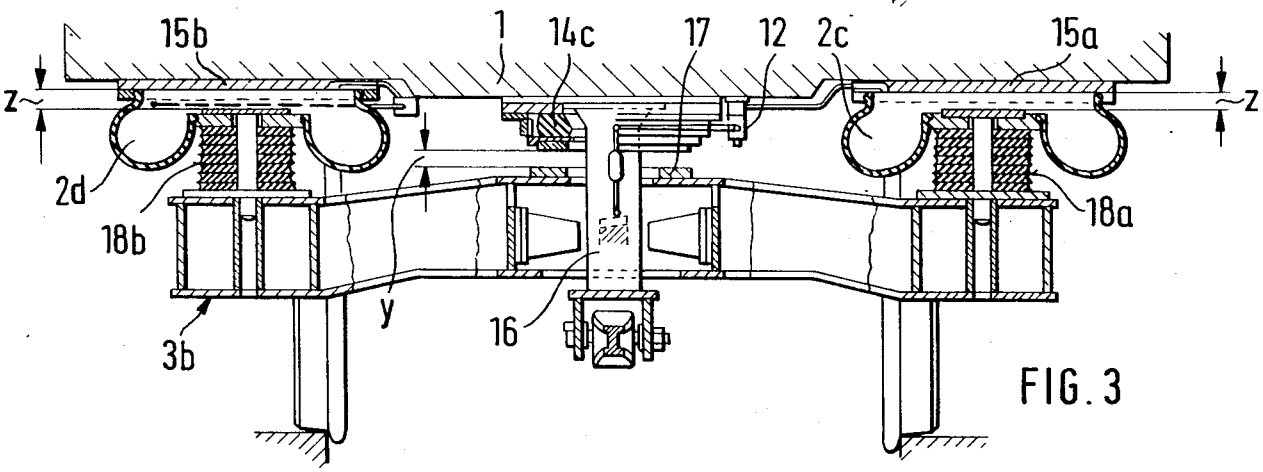
FIG. 3 is a section along the line III—III through a second bogie having an emergency support at the center of the car, and a centrally positioned leveling valve.

A second bogie 3*b* sectioned along the line III—III is shown in FIG. 3. The car body 1 is spring-supported via the lateral air spring bellows 2*c* and 2*d*. The emergency support action on the second bogie 3*b* is provided by a central emergency spring 14*c*, which is arranged at the centerline of the car around a kingpin or center pivot 16. This emergency spring 14*c* is arranged at a distance "y" from a stop 17 connected to the car body 1. The distance "y" corresponds to the clearance "x" of the emergency springs 14*a* and 14*b* in the first bogie 3*a*. The air spring bellows 2*c* and 2*d* are also formed with emergency supports 18*a* and 18*b* which, however, have a clearance "z" which is greater than the distance "y" of the emergency spring 14*c*, so that, if the air spring bellows should fail, only the emergency spring 14*c* would carry the load and, consequently, the bogie 3*b* would, without any constraint, be capable of performing swinging motions about its longitudinal axis to negotiate track twist.

In order to regulate the level of the car body 1, the air spring bellows 2*c* or 2*d* (in this case 2*c*) is connected to a third leveling valve 12, which is arranged at the center of the car in order to be actuated if a change in level occurs; this valve would not respond to swinging motions of the bogie 3*b* relative to the car body 1 when negotiating twisted track. The air spring bellows 2*b* and 2*d* are connected as shown in FIG. 1 by the equalizing line 13, and they are controlled jointly by the second leveling valve 4*b*.

The device according to the invention permits twisted track to be negotiated without any constraint and, consequently, simultaneously provides safety against derailing, regardless of the torsional softness or torsional stiffness of the car body 1.

The present invention is, of course, in no way restricted to the specific disclosure of the specification and drawings, but also encompasses any modifications within the scope of the appended claims.

What we claim is:

1. A combination arrangement for increasing the roll stability of a rail vehicle which is provided with air suspension, and in particular the roll stability of a car body having a first bogie and a second bogie; said combination arrangement comprising:

a first and second air spring bellows for spring-supporting said car body relative to said first bogie, which includes a bogie frame;

a first and second leveling valve, operatively connected with said first and second air spring bellows respectively for valve control thereof;

a third and forth air spring bellows for spring-supporting said car body relative to said second bogie, which includes a center pivot;

a third leveling valve, which, when viewed transverse to the direction of travel, is disposed near the center of said car body for controlling one of said third and fourth air spring bellows of said second bogie;

an equalizing line for connecting the other of said third and fourth air spring bellows of said second bogie with that one of said first and second air spring bellows of said first bogie which is disposed on the same side of said car body when viewed in the direction of travel;

a roll stabilizer disposed between said car body and said bogie frame of only said first bogie;

two first emergency springs, one integrated with each of said first and second air spring bellows of said first bogie; said first emergency springs each being in the form of a rubber-bonded-metal composite spring; and furthermore a central second emergency spring which extends concentrically around said center pivot of only said second bogie, for roll support stability, to permit said second bogie to have a degree of freedom about a longitudinal axis thereof so that the same can follow track twist distortion and that results in a three-point suspension simultaneously to provide assurance against de-railing regardless of track twist and distortion and to suppress vehicle rolling-wobbling movements especially even during air-spring-bellows failure without any sacrifice of capability of turning of said bogies during encountering of track twist and distortion;

said roll stabilizer comprising a torsion bar which is mounted in said bogie frame of only said first bogie, transverse to the direction of travel, and parallel to a horizontal plane; said torsion bar having two ends, each of which is provided with a lever which is parallel to the direction of travel, and also parallel to a horizontal plane; each of said levers having two ends, with that end remote from said torsion bar being connected by a respective link to said car body; each of said links extending at substantially right angles to its lever.

* * * * *